United States Patent [19]

de Poray et al.

[11] Patent Number: 4,488,514

[45] Date of Patent: Dec. 18, 1984

[54] SOLID FUEL BOILER OF THE RADIATING FURNACE TUBE TYPE, METHOD FOR CONVERTING A BOILER AND MEANS FOR CARRYING OUT SAID METHOD

[76] Inventors: Marcel C. K. de Poray, "Villa Suez" Rue Fournier, 83110 Sanary-Sur-Mer; Roland Kissel, 12 Rue Albert ler, 78110 Le Vesinet, both of France

[21] Appl. No.: 493,852

[22] Filed: May 12, 1983

[30] Foreign Application Priority Data

May 17, 1982 [FR] France ..... 82 08603

[51] Int. Cl.[3] ..... F22B 7/12

[52] U.S. Cl. ..... 122/149; 122/135 R; 122/136 R; 122/160; 122/182 R

[58] Field of Search ..... 122/135 R, 136 R, 137, 122/149, 160, 182 R

[56] References Cited

U.S. PATENT DOCUMENTS

| | | | |
|---|---|---|---|
| 953,023 | 3/1910 | Doran | 122/136 R |
| 1,734,310 | 11/1929 | Taylor | 122/149 |
| 2,554,092 | 5/1951 | de Poray | 122/182 |
| 2,604,081 | 7/1952 | Henc | 122/149 |
| 2,638,878 | 5/1953 | Lemos et al. | 122/136 C |
| 2,674,981 | 4/1954 | Clarkson | 122/136 R |
| 2,879,862 | 3/1959 | Burden, Jr. | 183/6 |
| 3,477,411 | 11/1969 | Geithing | 122/135 R |

FOREIGN PATENT DOCUMENTS

| | | |
|---|---|---|
| 604368 | 10/1934 | Fed. Rep. of Germany . |
| 2550410 | 5/1977 | Fed. Rep. of Germany . |
| 247864 | 3/1947 | Sweden . |

*Primary Examiner*—Edward G. Favors

*Attorney, Agent, or Firm*—Sughrue, Mion, Zinn, Macpeak and Seas

[57] ABSTRACT

The boiler comprises a primary furnace in which the combustion reactions are initiated, a secondary furnace extended by a radiating tube in which the combustion reactions are terminated, a heating surface disposed around the radiating tube and means for causing the combustion gases issuing from the radiating tube to pass into the annular space between the radiating tube and the heating surface. The secondary combustion radiating tube comprises two coaxial chambers, the first chamber terminating in a convergent part which directs the combustion gases toward the second chamber and the second chamber being closed at its end and having at its entrance a diameter larger than the diameter of the end of the convergent part so as to define with the end of the convergent part an annular opening through which the combustion gases injected into the second chamber are discharged. Means are provided for circulating the gases thus discharged in the annular space between said heating surface and the second chamber.

8 Claims, 3 Drawing Figures

SOLID FUEL BOILER OF THE RADIATING FURNACE TUBE TYPE, METHOD FOR CONVERTING A BOILER AND MEANS FOR CARRYING OUT SAID METHOD

The present invention relates to a solid fuel boiler of the radiating furnace tube type and to a method for converting a liquid or gaseous fuel boiler into such a boiler.

The considerable increase in the price of liquid or gaseous fuels has restored the interest of solid fuels. Attempts have therefore been made to develop once again solid fuel boilers or to convert existing liquid or gaseous fuel boilers into solid fuel boilers.

In U.S. Pat. No. 2,554,092 M. C. K. de Poray has already disclosed a solid fuel boiler having multiple-stage combustion and including a primary furnace in which are initiated the combustion reactions and a furnace tube in which the combustion reactions are terminated after introduction of secondary air. The furnace tube is surrounded by a heating surface and the combustion gases discharged through the end of the furnace tube pass into the annular space between the furnace tube and the heating surface. The heating surface is thus heated both by radiation and by convection.

Further, in French Pat. No. 1,020,525, M. C. K. de Poray has disclosed a boiler comprising a primary furnace in which the combustion reactions are initiated and a secondary furnace having a refractory diffuser in which the combustion reactions are terminated after introduction of secondary air. The secondary furnace is extended by a metal furnace tube. As in the preceding patent, the thermal exchange occurs both by radiation and by convection.

The boilers disclosed in these documents however have drawbacks which are related in particular to the fact that the combustion gases are completely and directly sent back in the direction of the entrance of the furnace tube.

Thus the uniformisation of the thermal exchange by means of the secondary combustion radiating furnace tube is limited by the convection of the combustion gases in the direction of the entrance of the furnace tube where the temperature is already the highest owing to the preponderent radiation of the furnace tube in this part.

Moreover, the gases leaving the secondary combustion tube do not have a homogeneous structure and therefore do not have a homogeneous temperature. This is prejuciable to the good distribution of the heat transmissions and of the stresses in the heating surface. Further, when it is attempted to convert existing boilers having a horizontal furnace and to adapt the technique described hereinbefore, difficulties are encountered when, as is frequently the case, the circulation of the combustion gases along the heating surfaces is reversed and consequently expensive devices must be provided for reversing the direction of circulation of the gases.

An object of the present invention is to overcome these drawbacks by providing an improved boiler and a method for easily converting a large number of existing boilers into solid fuel boilers.

The present invention therefore provides a solid fuel boiler of the type comprising a primary furnace in which there are initiated the combustion reactions, a secondary furnace extended by a radiating tube in which the combustion reactions are terminated, a heating surface disposed around the radiating tube, and means for conducting the combustion gases issuing from the radiating tube into the annular space between the radiating tube and said heating surface, wherein the secondary combustion radiating tube comprises two coaxial chambers, the first chamber terminating in a convergent part which directs the combustion gases toward the secondary chamber and the second chamber being closed at its end and having at its entrance a diameter larger than the diameter of the end of said convergent part so as to define with this end an annular opening through which there are discharged the gases of combustion injected into the second chamber, and means are provided for circulating the discharged gases in the annular space between said heating surface and the second chamber.

Another object of the present invention is to provide a method for converting a liquid or gasesous fuel boiler comprising a cylindrical heating surface and smoke tubes the entrance of which is at the opposite end of the furnace, into a solid fuel boiler, wherein there is disposed in the space surrounded by said heating surface a secondary combustion radiating tube in which the gases coming from the primary combustion of a solid fuel are introduced, the secondary combustion radiating tube comprising two coaxial chambers, the first chamber terminating in a convergent part which directs the combustion gases toward the second chamber and the second chamber being closed at its end and having at its entrance a diameter larger than the diameter of the end of said convergent part so as to define with said end an annular opening through which the combustion gases injected into the secondary chamber are discharged, and there are provided means for circulating the gases thus discharged in the annular space between said heating surface and the second chamber, in the direction of the entrance of the smoke tubes.

The invention is described hereinafter in more detail with reference to the drawings which show solely embodiments of the invention.

Figure 1:
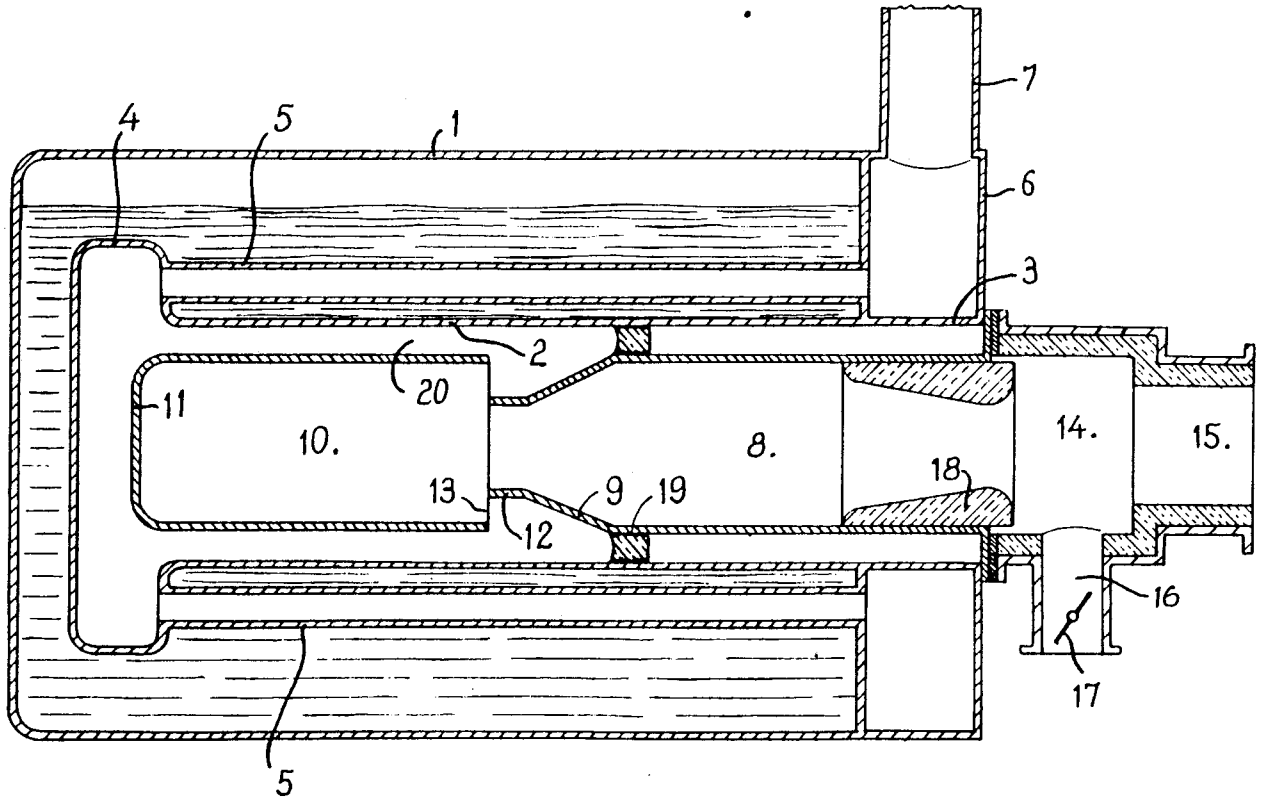
FIG. 1 is a vertical sectional view of one embodiment of a boiler according to the invention.

The boiler 1 shown in FIG. 1 is a boiler having a horizontal furnace. It comprises a cylindrical heating surface 2 having a horizontal axis and connected at the end remote from its entrance 3 by a smoke box 4 to smoke tubes 5 parallel to the heating surface 2. The smoke tubes 5 communicate with a front enclosure 6 provided with a flue 7. In the space defined by the heating surface 2 there is coaxially disposed a radiating tube comprising a first cylindrical chamber 8 terminating in a convergent part 9 and a second cylindrical chamber 10 whose end located in the smoke box 4 is closed by a wall 11. The two chambers 8 and 10 are coaxial and contiguous. The end 12 of the convergent part of the chamber 8 has a diameter less than the diameter of the chamber 10 so as to define between the end portion 12 of the convergent part 9 and the entrance of the chamber 10 an annular opening 13.

Disposed at the entrance of the radiating tube is a mixing chamber 14 having refractory walls including a conduit 15 for the admission of gases coming from a primary furnace (not shown), the conduit 15 having the same axis as the radiating tube, and a conduit 16 for the admission of secondary air and opening tangentially into the mixing chamber 14. The flow of secondary air entering the chamber 14 is controlled by a control device 17 disposed in the conduit 16.

A refractory diffuser 18 of cylindrical shape is disposed between the mixing chamber 14 and the cylindrical chamber proper 8.

The walls of the chamber 8 may be formed by a metal tube internally protected by a refractory lining or by a semi-refractory tube of the silicon carborundum carbide type which has a good resistance to high temperatures and thermal shocks.

The walls of the chamber 10 may be of metal and the wall 11 may include a refractory lining.

The walls of the chambers 8 and 10 may be composed of longitudinal elements having outer fins acting as a support while increasing their strength and the transmission of heat.

Further, an annular closure member 19 closes the annular passage 20 between the heating surface 2 and the radiating tube comprising the chambers 8 and 10 in the region of the end of the chamber 8 proper.

The boiler shown in FIG. 1 operates in the following manner:

Combustible gases coming from a primary furnace of the semi-producer type are introduced through the conduit 15 and the secondary air is introduced through the conduit 16 tangentially into the mixing chamber 14. The gaseous mixture in course of reaction passes through the refractory diffuser 18, which activates the combustion reactions, and enters the chamber 8 whose walls radiate heat towards the heating surface 2.

The gases are accelerated in the convergent part 9 and directed at high speed toward the end of the chamber 10. The gases are stopped by the wall 11 and sent back toward the annular opening 13 and enter the annular space 20 between the heating surface 2 and the radiating tube. These gases are again returned in the opposite direction by the annular closure member 19, ie. toward the smoke box 4 and then they pass through the smoke tubes 5 before reaching the chamber 6 and the flue 7.

Owing to the present invention, there is achieved a more uniform transmission of the heat, both by radiation and by convection. Thus, the radiation by convection only concerns the rear part of the secondary combustion radiating tubes which is that where the transmission by radiation is the lowest since its temperature is lower.

Further, the complex path of the gases inside the chamber 10 results in an intense agitation ensuring a homogeneous structure, and consequently a homogeneous temperature of the gases, which reduces the stresses in the heating surfaces.

Note also that the direction of circulation of the gases along the heating surface 2 is the same as that existing in many horizontal conventional boilers employing any type of fuel and in particular gaseous or liquid fuel. Thus it is possible easily to convert a liquid or gaseous fuel boiler comprising smoke tubes whose entrance is at the opposite end of the furnace into a solid fuel boiler according to the present invention.

Figure 2:
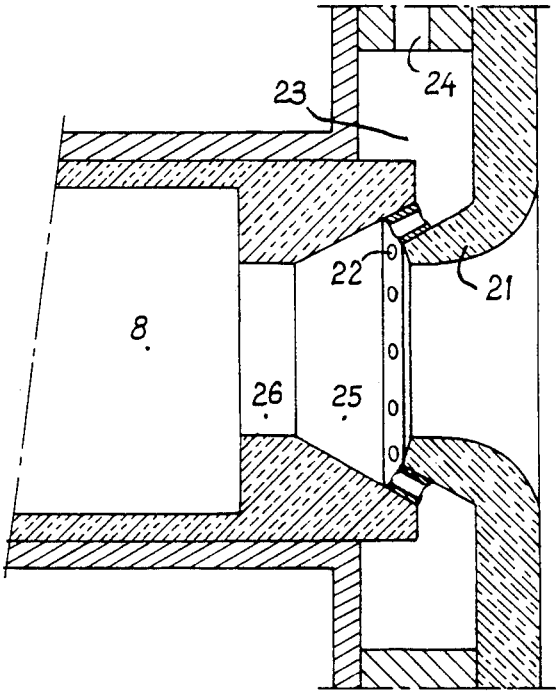
FIG. 2 is a vertical sectional view of an entrance orifice of a secondary combustion radiating tube employed in the present invention.

FIG. 2 shows a modification of the entrance of a radiating tube according to the present invention. This entrance includes a nozzle 21 having the same axis as that of the chamber 8 for introducing gases coming from a primary furnace. Disposed at the end of the nozzle 21 are peripheral orifices 22 for the aspiration of secondary air and communicating with a peripheral chamber 23 connected to a secondary air inlet conduit 24. The orifices 22 tangentially open onto a venturi 25 adjacent the nozzle 21. This venturi steeply diverges after its neck 26 and thus produces a peripheral recirculation of the gaseous mixture which enters and permits the suitable hooking and development of the flame. The combustion chamber 8 must have a sufficient length L so that the recirculation phenomenon is well developed therein.

The walls of the nozzle 21 and venturi 25 may be in particular formed by a refractory material.

With this device, the mixture of the gases coming from the primary furnace and the secondary air is improved and produces in the venturi 25 both an acceleration of the gases and a whirling of the gases in this venturi. A total combustion can thus be achieved within the chamber 8.

Figure 3:
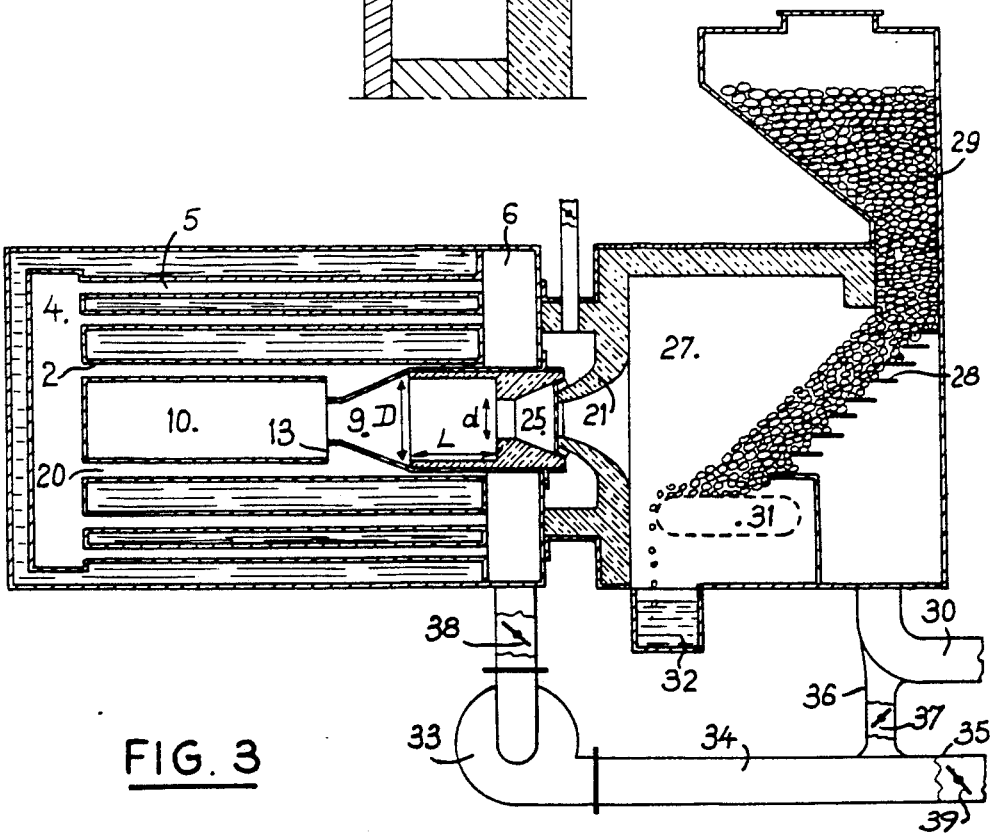
FIG. 3 is a vertical sectional view of a boiler according to the invention heated by means of a grate furnace.

A boiler according to the invention with a grate furnace is shown in FIG. 3. This boiler comprises a furnace 27 in which a stepped grate 28 is disposed, this grate being supplied with solid fuel by the effect of gravity from a hopper 29. The air is supplied through a conduit 30 disposed under the grate 28. Disposed at the base of the grate is a scraper 31 for causing the ashes to drop into an ash box 32 filled with water.

The gases issuing from this primary furnace enter a radiating tube according to the present invention through a device similar to that shown in FIG. 2, i.e. comprising in particular a nozzle 21 and a venturi 25 opening into the chamber 8. As in the structure shown in FIG. 1, the chamber 8 terminates in a convergent part 9 which opens into the chamber 10. The combustion gases are returned toward the end of the boiler in the smoke box 4, pass through the smoke tubes 5 and then into the enclosure 6. A fan 33 aspirates the smoke and in major part send it through a conduit 34 to a flue 35. A conduit 36 provided with a valve 37 permits returning a part of the smoke to the primary air inlet conduit 30. Valves 38 and 39 moreover respectively control the flows and the pressure of the smoke leaving the enclosure 6 and the smoke discharged into the flue 35.

This recycling of the smoke avoids formation of clinker.

Having now described our invention what we claim as new and desire to secure by Letters Patent is:

1. A solid fuel boiler, comprising: a primary furnace for initiating combustion reactions, a secondary furnace defined by extended radiating tube means in which the combustion reactions are completed, means defining a liquid containing heating surface (2) disposed around and defining an annular space with the radiating tube means, the radiating tube means implementing secondary combustion and comprising two coaxial chambers, a first one of said chambers (8) having an open convergent terminus (9) for directing combustion gases toward a second one of said chambers (10), said second chamber having a closed remote end (11) and an entrance having a diameter larger than the diameter of an adjacent end portion of said convergent terminus to define therewith an annular opening through which combustion gases injected into the second chamber are discharged, and means (19) for redirecting the gases thus discharged into a portion (20) of said annular space between the heating surface and the second chamber.

2. A boiler according to claim 1, wherein the means for redirecting the gases into said annular space comprises an annular closure member closing the space between the first chamber and said heating surface.

3. A boiler according to claim 1, wherein the first chamber comprises an entrance orifice in the shape of a nozzle (21) for the introduction of the gases coming from the primary furnace.

4. A boiler according to calim 3, wherein peripheral orifices (22) for the aspiration of secondary air are disposed in the vicinity of an inner end of the nozzle.

5. A boiler according to claim 4, wherein the peripheral orifices open into a venturi (25).

6. A boiler according to claim 5, wherein the venturi has a neck portion (26) and a steeply divergent portion adjacent to the neck and adjacent to the pheripheral orifices.

7. A method for converting a fluid fuel boiler into a solid fuel boiler, said fluid fuel boiler including means defining a cylindrical, liquid containing heating surface (2) surrounding a combustion chamber and a plurality of smoke tubes (5) each having an entrance located at an end of the combustion chamber opposite an entrance thereof, said method comprising: inserting in the combustion chamber space surrounded by said heating surface a secondary combustion radiating tube into which gases coming from a primary combustion furnace for solid fuel are introduced, the secondary combustion radiating tube comprising two coaxial chamber, a first one of said chambers (8) having an open convergent terminus (9) for directing combustion gases toward a second one of said chambers (10), said second chamber having a closed remote end (11) and an entrance having a diameter larger than the diameter of an adjacent end portion of said convergent terminus to define therewith an annular opening (13) through which combustion gases injected into the second chamber are discharged, and providing means (19) for redirecting the gases thus discharged into an annular space (20) between said heating surface and the second chamber in the direction of the entrance of the smoke tubes.

8. A secondary combustion radiating tube for a solid fuel boiler, said tube comprising: two coaxial chambers, a first one of said chambers (8) having an open convergent terminus (9) and a second one of said chambers (10) having a closed remote end (11) and an entrance having a diameter larger than the diameter of an adjacent end portion of said convergent terminus to define therewith an annular opening (13), wherein the first chamber comprises an entrance orifice in the shape of a nozzle (21) and wherein peripheral orifices (22) are disposed in the vicinity of an end of said nozzle for the aspiration of secondary air, said orifices opening into a venturi (25) comprising a neck portion (26) and a steeply divergent portion having one end adjacent to the neck portion and another end adjacent to the peripheral orifices.

* * * * *